United States Patent [19]

Neki et al.

[11] Patent Number: 4,691,653

[45] Date of Patent: Sep. 8, 1987

[54] SEWING MACHINE CONTROL APPARATUS

[75] Inventors: Shigeo Neki, Osaka; Kenichi Ohara, Hirakata; Nobuho Shibata, Katano; Takashi Dohi, Hirakata, all of Japan

[73] Assignee: Matsushita Electric Industrial Co., Ltd., Kadoma, Japan

[21] Appl. No.: 926,534

[22] Filed: Nov. 4, 1986

[30] Foreign Application Priority Data

Nov. 6, 1985 [JP] Japan ..... 60-248214

[51] Int. Cl.[4] ..... D05B 69/24

[52] U.S. Cl. ..... 112/275; 318/369

[58] Field of Search ..... 112/275, 277, 67, 87; 318/369, 269, 270, 371, 375

[56] References Cited

U.S. PATENT DOCUMENTS 4,516,514 5/1985 Neki et al. ..... 112/275

4,517,909 5/1985 Neki et al. ..... 112/275

*Primary Examiner*—Peter Nerbun

*Attorney, Agent, or Firm*—Cushman, Darby & Cushman

[57] ABSTRACT

In a control device for a sewing machine control apparatus wherein an electric motor generates a reverse torque against a torque due to a load on the sewing machine in abeyance state, to hold a sewing needle in an upper or a lower position, the reverse torque reaches a maximum value by a known feedback system at its turn to a predetermined revolution angle. The control apparatus is devised such that, when it is further turned in excess of the predetermined revolution angle, the reverse torque falls to zero, hence the driving motor remains at the position turned to the predetermined revolution angle.

8 Claims, 5 Drawing Figures

SEWING MACHINE CONTROL APPARATUS

FIELD OF THE INVENTION AND RELATED ART STATEMENT

1. Fields of the Invention

The present invention relates generally to a sewing machine, and particularly to a control apparatus for controlling a electric motor thereof.

2. Description of the Related Art

In a control apparatus for controlling an electric motor of a sewing machine, in keeping an upper needle position when the electric motor stops, in the prior art there is a problem that the needle does not always stop precisely at the upper position due to a load of the sewing machine and the needle position deviates from a precise upper position. In a worst case, the electric motor stops in a state that the needle is put through a cloth, and an operator can not remove the cloth from the sewing machine. In order to prevent the above-mentioned trouble, an electromagnetic brake device which comprises a brake coil, a magnetic circuit member and a brake lining is provided to the electric motor. In such constitution, a little activating current is continuously supplied to the brake coil after the electric motor is stopped at the upper needle position. Hence the needle is held firm at the upper position.

In the above-mentioned method of the prior art, the holding of the needle position is realized by flowing of the little activating current in the brake coil, and its control means is made comparatively easily by a transistor circuit for driving the brake coil and a restricting resistor, for example. However, the electromagnetic brake apparatus is required besides the electric motor, and consequently, the complex mechanisms are required, and therefore it is generally expensive in total cost.

OBJECT AND SUMMARY OF THE INVENTION

In order to overcome the above-mentioned problem, a sewing machine control apparatus in accordance with the present invention is characterized by providing besides conventional members a pulse generator for generating a plurality of pulse signals corresponding to revolution of the electric motor, a speed control means for controlling the revolution speed of the electric motor so as to coincide with a predetermined revolution speed, a rotating direction detecting means for detecting a rotating direction of the electric motor, counting means for counting output pulses from the pulse generator, converting means for converting an output Ca of an absolute value circuit 6 and comparating means for comparing speed set value with an absolute value of the absolute value circuit.

That is, the sewing machine control apparatus in accordance with the present invention comprises:

an electric motor for driving a sewing machine, a rotary encoder connected to said electric motor for generating pulse signals corresponding to revolution of the electric motor, speed setting means for setting revolution speed of the electric motor, speed control means for controlling the revolution speed of the electric motor in compliance with setting value of revolution speed set by the speed setting means, rotating direction discriminating means for detecting rotating direction of the electric motor, counting means for summing or deducting the number of pulse signals corresponding to output signals of the rotating direction discriminating means, comparating means for comparing and for detecting coincidence of data of the counting means and a predetermined value thereby to reset the counting means, converting means for converting the data of the counter to the setting value, and switching means for selecting an output of the speed setting means in a rotating state of the electric motor and for selecting an output of the converting means in a state of stop of the electric motor.

In the present invention, the counting means counts the number of pulse signals corresponding to number of pulses of an output signal of the rotating direction detecting means and outputs a resultant value. The resultant count value is compared with a predetermined value by comparating means, and when the resultant value reaches and coincides with the predetermined value, the comparating means outputs a signal for resetting the counting means. On the other hand, the converting means outputs a signal for generating a holding torque of the electric motor through conversion of the resultant value to the predetermined revolution speed.

DESCRIPTION OF THE PREFERRED EMBODIMENTS

Figure 1:
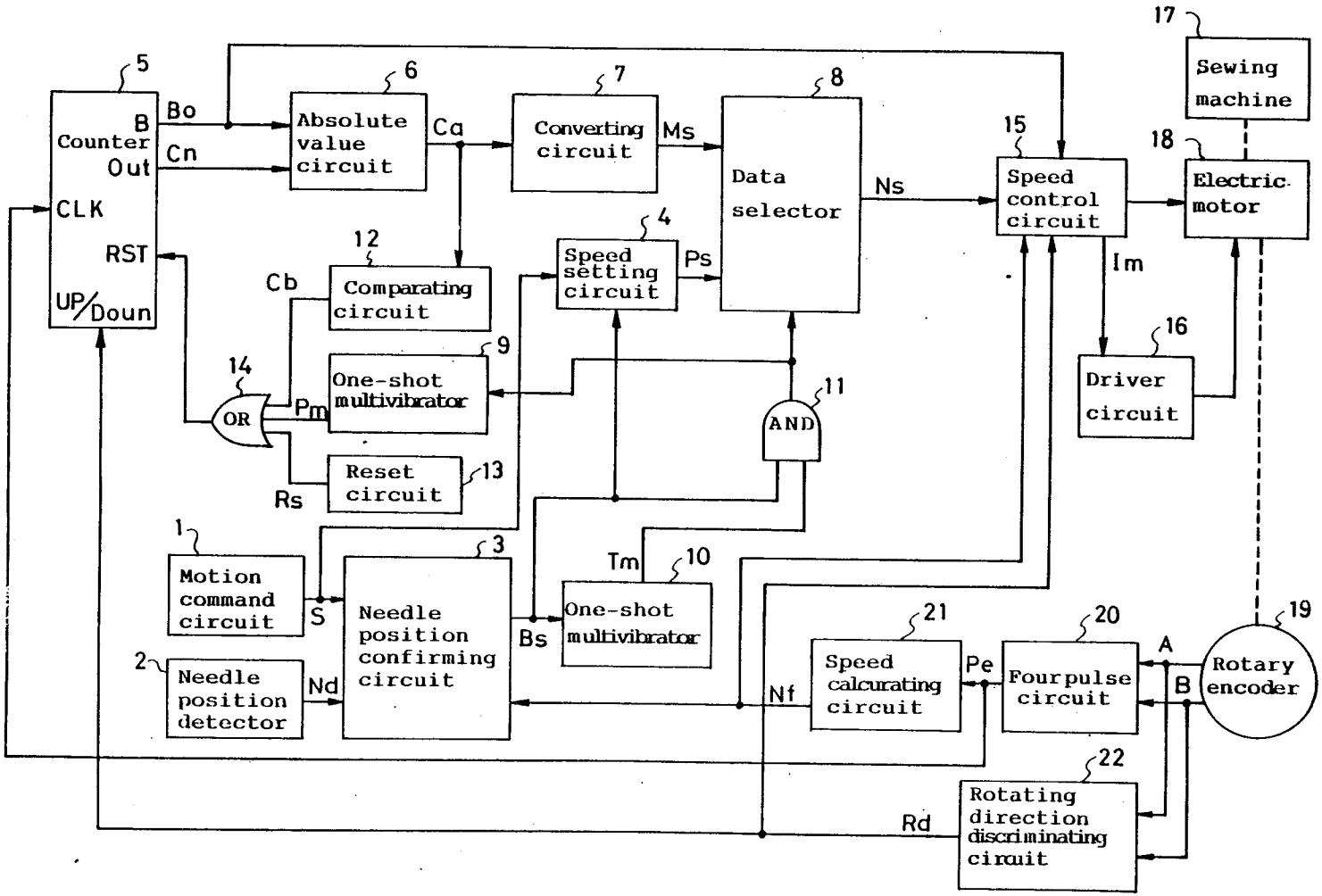
FIG. 1 is a block diagram of an embodiment in accordance with the present invention.

A block diagram of an embodiment of a sewing machine control apparatus in accordance with the present invention is shown in FIG. 1. Referring to FIG. 1, a motion command circuit 1 outputs a signal for starting or for stopping an electric motor 18 when a main switch (not shown) is closed or opened, or an operator steps down or hold in neutral a control pedal (not shown), respectively. A needle position detector 2 comprises a magnet attached on a shaft of the sewing machine 17 and a hole device or by a photo-sensor for sensing a rotating reflection plate, and it outputs a needle position signal Nd when the needle is at a lower position or an upper position. A speed setting circuit 4 outputs a speed setting signal Ts corresponding to a position of a pedal stepped down or a value set by a variable resistor (not shown). A device designated by numeral 5 is a counter. An absolute value circuit 6 comprises a logic circuit. A converting circuit 7 comprises a multiplier 23 and switches $S_{01}$ $S_{11}$ $S_{21}$ and $S_3$ for setting a maltiplier of the maltiplier 23. A data selector 8, one shot multi-vibrators 9 and 10 and an AND gate 11 are formed by discreet ICs. A comparating circuit 12 comprises switches $S_4$ $S_5$ $S_6$ and $S_7$ for setting a predetermined digital data, two D/A converters 24 and 25 and a comparator 26. A reset circuit 13 outputs reset signal Rs when a power source is applied to the control circuit. A speed control circuit 15 outputs an output In to a driver circuit 16. The driver circuit 16 drives the electric motor 18 which is directly connected to the sewing machine or which is connected thereto through a driving belt. The driver circuit 16 comprises a power transistor and a power supply circuit for the electric motor. A rotary encoder 19 comprises, for example, a multi-pole magnet rotated with the shaft of the electric motor and a magnetic censor such as a magnetic resistance device and detects the revolution of the electric motor. A known rotary encoder compring a rotary disk having slits thereon and two photosensors is also usable. In these rotary encoders, rotating directions of their shafts are sensed by known operation of two series of the output pulse signals wherein phase difference thereof is 90 degrees.

A four pulse circuit 20 generates a four pulse signals Pe at the rise edge and the fall edge of both the two series of the output signals of the rotary encoder. A speed calculating circuit 21 outputs a real speed signal Nf showing a real speed of the electric motor 18 by calculation of the four pulse signals Pe in a timer and a calculating circuit included therein. A rotating direction discriminating circuit 22 discriminates the rotating direction of the electric motor 18 by known operation of the phase difference between the above mentioned two series of the pulse signals from the rotary encoder. Thus a rotating direction designating signal Rd is issued and is given to the counter 5 and the speed control circuit 15.

Operation of the sewing machine control apparatus is elucidated as follows:

At first, an output signal S for starting the sewing machine control apparatus is issued from the motion command circuit 1, and the speed setting circuit 4 outputs a signal corresponding to a speed setting value Ps set by operation of the pedal. The output Bs of the needle position confirming circuit 3 turns to "L" of a logic level, thereby a data selector 8 is changed so as to select the above mentioned speed setting value Ps. Then an output signal Ns corresponding to the speed setting value Ps is issued from the data relector 8. The speed control circuit 15 is controled by the output signal Ns and issues an output Im. The output Im is applied to the driver circuit 16. Hence the electric motor 18 is driven so as to minimize the difference between the output signal Ns and the value of the real speed signal Nf. Consequently the electric motor 18 rotates in a rotating speed corresponding to the speed setting value Ps.

A process for stopping the sewing machine 17 is elucidated as follows:

When an output signal S for stopping the sewing machine is issued from the motion command circuit 1 by operation of the pedal, the speed setting circuit 4 outputs a speed setting value Ps which makes the electric motor 18 to rotate in a predetermined low speed, for example a revolution speed of 10% of the normal revolution speed, during a predetermined initial time period, for example 0,1–0,5 seconds. Hence the speed control circuit 15 outputs a signal for braking the electric motor 18 in order to reduce the difference between the speed setting value Ps showing a low speed and the value of the real speed signal Nf. The output signal Bs of the needle position confirming circuit 3 turns to "H" of logic level when the value of the real speed signal Nf reaches to the value of the speed setting value Ps. Then, when a rise edge of the needle position signal Nd is detected, the output signal Bs of logic level "H" is applied to the speed setting circuit 4, and the speed setting signal Ps of the speed setting circuit 4 turns to "L". The speed control circuit 15 outputs a signal for braking and for stopping the electric motor 18. On the other hand, an output Tm of the one shot multivibrator 10, being triggered by the output signal BS, remains logic level to "L" during a predetermined time period which is necessary to stop the electric motor 18, and after the predetermined time period the output Tm turns logic level to "H". At the same time, an output of the AND gate 11 turns logic level to "H". Hence the data selector 8 is changed to select the speed setting output Ms of the converting circuit 7, simultaneously, a pulse signal Pm is issued from the one shot multivibrator 9. The pulse signal Pm resets the counter 5 through the OR gate 14.

Figure 2:
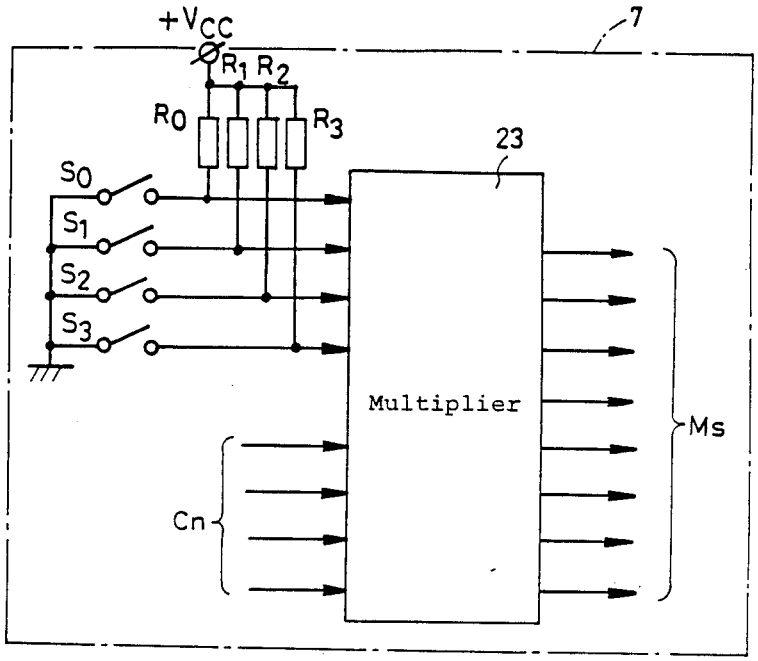
FIG. 2 is an embodiment of a converting circuit.
Figure 3:
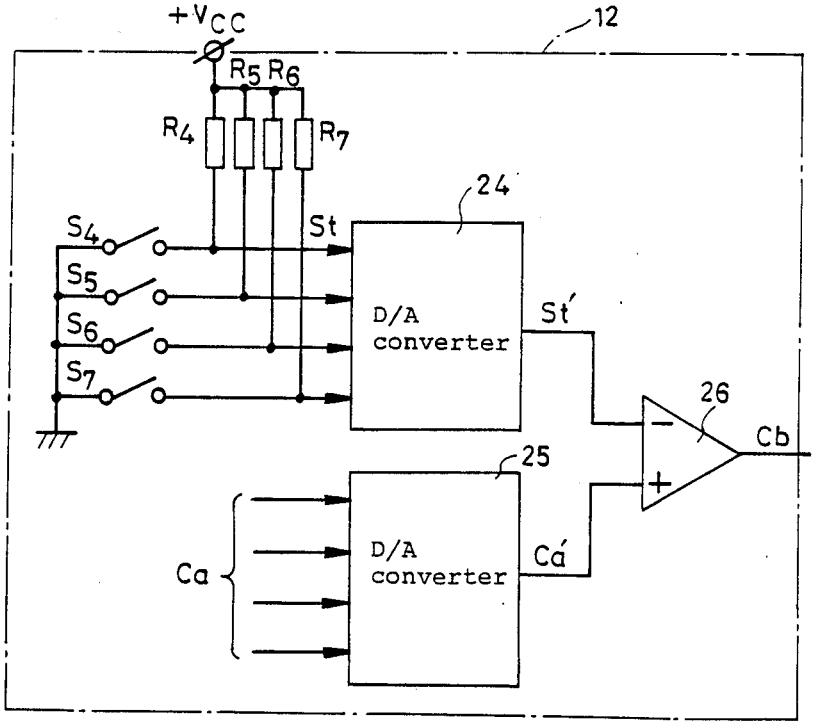
FIG. 3 is an embodiment of a comparating circuit.

An embodiment of the converting circuit 7 and a comparating circuit 12 are shown in FIG. 2 and FIG. 3, respectively. In FIG. 2, the converting circuit 7 comprises resistors $R_0$, $R_1$, $R_2$ and $R_3$, switches $S_0$, $S_1$, $S_2$ and $S_3$ for selecting the resistors, and a multiplier 23. The multiplier 23 calculates data formed by four bits and issues data formed by eight bits. In FIG. 3, the comparating circuit 12 comprises resistors $R_4$, $R_5$, $R_6$ and $R_7$, switches $S_4$, $S_5$, $S_6$ and $S_7$ for selecting the resistors, D/A convertors 24 and 25 and a comparator 26.

When the predetermined time period which is necessary to stop the electric motor 18 elapses, the counter 5 is reset. After stopping of the electric motor 18, when a load is given to the sewing machine 17, for example to the forward rotating direction of the sewing machine, the electric motor 18 is rotated thereby. The rotary encoder 19 turns with the electric motor 18, and the outputs two series pulse signals A and B from the rotary encoder 19 are applied to the four pulse circuit 20. Output four pulse signals Pe from the four pulse circuit 20 are applied to the counter 5 and make the count in the counter 5 be reduced in compliance with the rotating direction designating signal Rd with corresponds to the load of forward direction, and the resultant signal Cn is issued from the counter 5 to the absolute value circuit 6.

In the above-mentioned counting process, since the counter 5 is reset at initial state, the counted value becomes a minus number, then a borrow signal Bo is issued. The absolute value circuit 6 outputs an absolute value data Ca by means of the above-mentioned resultant signal Cn and the borrow signal Bo. The absolute value data Ca is multiplied by a multiplier data Sg set by the switches $S_0$, $S_1$, $S_2$ or $S_3$ in the converting circuit 7, and thereby, signal Cn from the counter 5 is converted to a speed setting value data, and an output Ms of the speed setting value signal is issued. Then, speed control circuit 15 controls rotation of the electric motor 18 in a reverse rotating direction since the borrow signal Bo is issued and the real speed signal Nf is substantially 0.

When the load supplying to the sewing machine gradually increases, an absolute value Ca of the resultant signal Cn of the counter 5 increases in proportion to the output Ms of speed setting value signal, and hence the output Im of the speed control circuit 15 increases responding to the speed setting value Ps. Hereupon, the output Im is a value which changes in proportion to the difference between speed setting value Ps and real speed signal Nf, and it is a value for deciding the current of the electric motor 18 which is driven by the driver 16. The real speed signal Nf becomes about zero, since the change of the load is very slowly, and therefore the current of the value corresponding to the speed setting signal Ms flows into the electric motor 18.

In case that the direct current motor is used as the electric motor 18, since the torque is proportional to the current flowing into the motor, the electric motor 18 rotates with a torque in accordance with the output Ms of the speed setting value signal.

On the other hand, in case that the load slowly changes in a reverse direction of the sewing machine, the signal Rd for designating rotating direction is issued to designate reverse rotation, and hence the four pulse signal Pe is added in the counter 5 and the resultant signal Cn is issued from the counter 5. In this time, the borrow signal Bo is not generated. The speed control circuit 15 generates the output Im of the current designating value signal so as to rotate the electric motor 18 in the forward rotating direction. The driver 16 drives the electric motor 18 responding to the current designating value signal.

As mentioned above, when the load adding to the sewing machine changes to the forward or the reverse direction, the electric motor is driven so as to offset the change by the feed back control thereof. On the other hand in the stopped state of the sewing machine, the operator requires to move the position of the needle under the above-mentioned control system, for example in order to pass thread through an eye of the needle. A control process is provided to allow movement of the needle position for the above-mentioned case.

An embodiment of the comparating circuit 12 is shown in FIG. 3. A digital value St for deciding the rotating angle of the sewing machine is set by the manual switches $S_4$, $S_5$, $S_6$ or $S_7$. The digital value St is converted to an analog value St' by the D/A converter 26. The absolute value data Ca is converted to an analog value Ca' by the D/A converter 25. The analog values St' and Ca' are compared by the comparator 26, and when the analog value Ca' coincides with the analog value St', an output Cb of the comparator 26 turns logic level to "H", and the counter 5 is reset through OR gate 14.

When the counter 5 is reset, the counted value thereof becomes zero, and the absolute value output Ca and the speed setting value Ms becomes zero and hence the current flowing into the electric motor becomes zero. As a result, the operater can freely move the needle position by hand.

As mentioned above, the data St sets such a range of the range a position change from the initial position, in which is capable of feedback control is possible. This value shows the current value of the electric motor or the torque. The load of the normal sewing machine is controlled by the above-mentioned feedback control. When the power source is supplied to the control circuit, a reset signal Rs is issued and the counter 5 is reset to the initial state, and thereby a misoperation of the electric motor is prevented.

Figure 4:
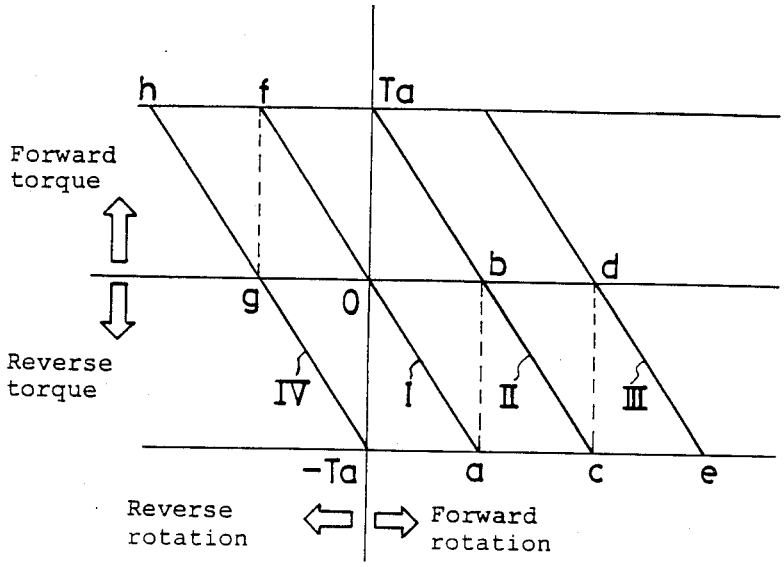
FIG. 4 is a graph showing a characteristics of a torque of an electric motor VS. a deviation of the needle position.

A characteristic curve of the torque VS. the rotational position of the electric motor is shown in FIG. 4. Referring to FIG. 4, when for example, a forward load is given to the sewing machine, a reverse torque of the electric motor as shown by a torque line I is generated. And when the needle position further proceeds by an increase of the load and the rotation position reaches to the set value St, the reverse torque reaches to a value shown by a point "a". When the motion of the needle position proceeds, the graph of the reverse torque shifts from the torque line I to a torque line II and the torque of the electric motor becomes zero (point "b"). Furthermore, when the motion of the needle further increases, the reverse torque of the electric motor changes along the torque lines b-c and d-e.

On the contrary, when a reverse rotating load is given to the sewing machine, the torque of the electric motor changes along the torque lines of 0-f and g-h. As mentioned above, when the sewing machine is rotated by hand, a torque shown by a sawtoothform wherein the maximum torques are set by predetermined values Ta or −Ta generates in the electric motor. In the normal operation of the sewing machine, the load applied to the sewing machine is small and is under the maximum torque ±Ta, and therefore the range of the torque is within a value shown by the torque line I, and the needle stops within a small deviation of position to the predetermined position.

In this embodiment, the torque lines I, II, III and IV are shown by linear lines, but various torque lines are realizable by different constitutions of the speed control circuit 15. A torque line which generates a torque oposing to the addition of the load, for example shown by a curve, is usable in the present invention.

The gradient of the above-mentioned torque line shows a gain in the control system. When the gain is smaller than a predetermined value, a deviation of the position in a state of a balance of the load and the torque increases. On the contrary when the gain is larger than that, the control system is liable to becomes unstable. Therefore, a suitable gain of the control system is requested. In order to obtain a suitable gain in the control system, a multiplying coefficient in the multiplying circuit is switched by the switches $S_0$, $S_1$, $S_2$ or $S_3$ in the converting circuit 7, thereby the gain of the converting circuit 7 is changable.

Figure 5:
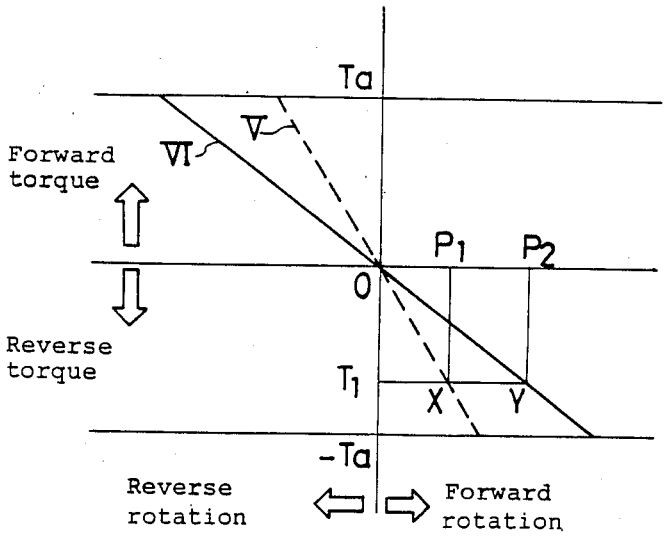
FIG. 5 is a graph showing a characteristics of the torque of the electric motor taking a set gain of a converting circuit as parameter.

The torque of the electric motor corresponding to the difference of the rotating position is shown in FIG. 5. Referring to FIG. 5, a dotted line V shows a torque line wherein the gain of the conventing circuit 7 is higher than that of the torque line VI. When a load of a torque $T_1$ is applied, the respective positional deviations corresponding to the torque lines V and VI are shown by $P_1$ and $P_2$, respectively. The positional deviations $P_1$ in accordance with the torque line V is smaller than the declination $P_2$ in accordance with the torque line VI.

In the present invention, since the torque for compensating the load given to the sawing machine is adjustable, the sawing machine control apparatus can be applied to the various type of the sawing machine.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. Sewing machine control apparatus comprising:

an electric motor for driving a sewing machine, a rotary encoder connected to said electric motor for generating pulse signals corresponding to revolution of said electric motor, speed setting means for setting revolution speed of said electric motor, speed control means for controlling said revolution speed of said electric motor in compliance with setting value of revolution speed set by said speed setting means, rotating direction discriminating means for detecting rotating direction of said electric motor, counting means for summing or deducting the number of pulse signals corresponding to output signals of said rotating direction discriminating means, comparating means for comparing and for detecting coincidence of data of said counting means and a predetermined value thereby to reset said counting means, converting means for converting said data of the counter to the setting value, and switching means for selecting an output of said speed setting means in a rotating state of said electric motor and for selecting an output of said converting means in a state of stop of said electric motor.

2. Sewing machine control apparatus in accordance with claim 1, wherein said comparating means comprises plural switches for selecting one of predetermined values which controls resetting of said counting means.

3. Sewing machine control apparatus in accordance with claim 1, wherein said converting means comprises gain-setting means having plural switches and a multiplier, and multiplies said counted value by a value set by said gain setting means.

4. Sewing machine control apparatus in accordance with claim 1, wherein said counting means comprises reset means for resetting said counting means when a power source is supplied.

5. Sewing machine control apparatus comprising:

an electric motor for driving a sewing machine, a rotary encoder connected to said electric motor for generating two series of pulse signals having a phase difference of 90 degrees from each other corresponding to revolution of said electric motor, speed setting means for setting revolution speed of said electric motor, speed control means for controlling said revolution speed of said electric motor in compliance with setting value of revolution speed set by said speed setting means, rotating direction discriminating means for detecting rotating direction of said electric motor by operation of said phase difference between the two series of the pulse signals, counting means for summing or deducting the number of pulse signals corresponding to output signals of said rotating direction discriminating means, comparating means for comparing and for detecting by coincidence of data of said counting means and a predetermined value thereby to reset said counting means, converting means for converting said data of said counter to said speed setting value, and switching means for selecting an output of said speed setting means in a rotating state of said electric motor and for selecting an output of said converting means in a state of stop of said electric motor.

6. Sewing machine control apparatus in accordance with claim 5, wherein said comparating means comprises plural switches for selecting one of predetermined values which controls resetting of said counting means.

7. Sewing machine control apparatus in accordance with claim 5, wherein said converting means comprises gain-setting means having plural switches and a multiplier, and multiplies said counted value by a value set by said gain setting means.

8. Sewing machine control apparatus in accordance with claim 5, wherein said counting means comprises reset means for resetting said counting means when a power source is supplied.

* * * * *